United States Patent [19]

Bender

[11] 4,046,166

[45] Sept. 6, 1977

[54] RECIPROCATING VALVE FOR A DOUBLE PISTON CONCRETE PUMP

[75] Inventor: Horst Bender, Biebergemuend, Germany

[73] Assignee: WIBAU (Westdeutsche Industrie- und Strassenbau-Maschinen Gesellschaft m.b.H.), Gruendau-Rothenbergen, Germany

[21] Appl. No.: 685,999

[22] Filed: May 13, 1976

[30] Foreign Application Priority Data

June 14, 1975 Germany ..... 2526767
Dec. 12, 1975 Germany ..... 2555947

[51] Int. Cl.[2] ..... F04B 7/00; F16K 11/06

[52] U.S. Cl. ..... 137/625.48; 417/517

[58] Field of Search ..... 417/517, 900; 137/625.48, 625.68; 251/DIG. 1

[56] References Cited

U.S. PATENT DOCUMENTS

| | | | |
|---|---|---|---|
| 3,000,610 | 9/1961 | Bryant | 251/DIG. 1 |
| 3,682,575 | 8/1972 | Guddal | 137/625.48 X |
| 3,909,160 | 9/1975 | Sherrod | 417/517 |
| 3,914,074 | 10/1975 | Bille | 417/900 |

*Primary Examiner*—William R. Cline
*Attorney, Agent, or Firm*—W. G. Fasse; W. W. Roberts

[57] ABSTRACT

The present valve is especially adapted for use in conduits through which construction mixtures, such as concrete mixtures, flow. The valve cooperates with a pump having pistons in two respective pump cylinders. A valve housing forms a valve piston chamber having plane walls. The valve plug or piston has also plane walls to fit into the valve chamber with respective plane walls. Three pairs of ports are provided. One pair is connected to the pump cylinders. Another pair is connected to a discharge conduit and a third pair is connected to a supply container for the concrete mix. Preferably, the cross sectional shape of the valve chamber and of the piston plug is triangular. However, the cross sectional shape may also form a quadrangle. Providing the valve chamber and the valve plug piston with plane walls facilitates the manufacture of the valve and improves its sealing characteristics.

12 Claims, 4 Drawing Figures

FIG. 1

SECT.C-D

SECT.A-B

RECIPROCATING VALVE FOR A DOUBLE PISTON CONCRETE PUMP

BACKGROUND OF THE INVENTION

The present invention relates to a reciprocating valve for double piston concrete pumps. The purpose of such valves is to control the operation of the pump to convey a concrete mix from a supply container into a conveying conduit. The two pump cylinders are arranged in parallel to each other and the housing of the valve control mechanism extends substantially at a right angle to the longitudinal extension of the two pump cylinders. The housing of the valve interconnects the two pump cylinders. Suction ports are connected to the supply container and to the pump and discharge ports are connected to the conveying conduit which, for example, may have a Y-configuration at its valve connected end.

My U.S. Pat. No. 3,889,713 granted on June 17, 1975 describes a reciprocating valve of the above type which has a cylindrical valve housing in which the piston plug operates with the function of "suction-pressure-suction" in that order.

The valve of my above U.S. Patent has several advantages. One advantage is seen in the very short displacement of the valve plug piston. Another advantage is seen in the fact that the suction cross sectional areas from the supply container extend directly through the valve plug piston, whereby sharp bends can be avoided and the concrete mix can flow through passageways having gentle bends of about 75°.

However, my above Patent leaves room for improvement, especially with regard to the sealing between the ports in the housing and the respective passageways through the valve plug piston. Since the valve piston is cylindrical, the exit openings or ports around the passageways through the valve plug piston have a configuration which is determined by the cylindrical shape of the piston. Thus, these openings are substantially oval and it is difficult to properly maintain a sealing around these oval openings. The present invention aims at improving the sealing characteristics.

Swiss Pat. No. 372,927 describes a concrete pump having a control piston with a square cross section. The piston is provided with a straight passageway for the concrete during the conveying stroke and with a 90° passageway in the form of an elbow or knee bend connected to the supply container through which the concrete flows during the suction stroke of the pump. This known valve mechanism is suitable for cooperation with a single cylinder pump. It has the advantage of using sealing means in a plane surface rather than in a surface which is bent in accordance with the shape of a cylinder. However, it is a disadvantage that the knee bend requires a 90° deflection of the concrete, which causes a high suction resistance, whereby differential speeds of the concrete flow cannot be avoided. This has several disadvantages. On the one hand the knee bend passageway is subject to substantial wear and tear and on the other hand the consistency of the concrete mix may vary, because the differential speeds tend to demix the concrete mixture.

OBJECTS OF THE INVENTION

In view of the foregoing, it is the aim of the invention to achieve the following objects singly or in combination:

to provide a control valve for a double piston pump for the conveyance of concrete mixtures or the like, wherein the control piston plug of the valve shall have plane surfaces so that the sealing means will extend in such plane surfaces around the ports for the respective passageways;

to avoid any sharp bends in the passageways through the valve plug, especially 90° bends are to be avoided for the above reasons;

to construct the valve plug and valve housing in such a manner that demixing of the concrete mix is avoided as it flows through the passageways;

to avoid a high suction resistance in the passageways through the valve plug;

to avoid a cylindrical valve plug while simultaneously assuring a relatively light-weight construction, especially of the valve plug; and to construct a valve plug in such a manner that it avoids a square cross section while simultaneously permitting a gentle bend in the suction passageways and a straight passageway for the discharge of the concrete mix, whereby the pressure on the valve housing walls is kept to a minimum and whereby a wedging or jamming of the control piston plug is avoided while simultaneously increasing the required power for operating the valve and thus increasing the efficiency.

SUMMARY OF THE INVENTION

According to the invention there is provided a reciprocating valve for a double piston concrete pump comprising a valve plug piston in a respective valve housing, whereby the piston and the housing have a cross sectional area bounded by plane surfaces at least two of which include an angle smaller than 90°. The cross sectional area may thus be a triangle or a quadrangle, but not a square. For example, the cross sectional shape of the piston and valve housing may be determined by at least three edges extending in parallel to each other and through the intersections of enveloping lines abutting the plane surfaces of the piston and housing.

In one embodiment thus the piston may be a three surface prism, whereby the advantage is achieved that the ports for the passageways through the piston are located in plane surfaces. Accordingly any sealing means surrounding the ports in the piston or in the valve housing walls are also located in plane surfaces.

Due to the triangular or quadrangular shape of the piston, it is possible to arrange the passageways in a flow facilitating manner so as to take advantage of gravity, whereby the position of the prism and the angles between the three or four surfaces may be selected in accordance with the individual requirements. Due to the triangular cross section of the valve plug, the pressure passageway will be bent. However, such bend is substantially less than 90° and has been found to be acceptable especially in a medium pressure range. Any pressure loss due to the bend is minimal, as compared to pressure losses in the Y-conduit member and in the bends of the conveyor conduit.

BRIEF FIGURE DESCRIPTION

In order that the invention may be clearly understood, it will now be described, by way of example, with reference to the accompanying drawings, wherein.

Figure 1:
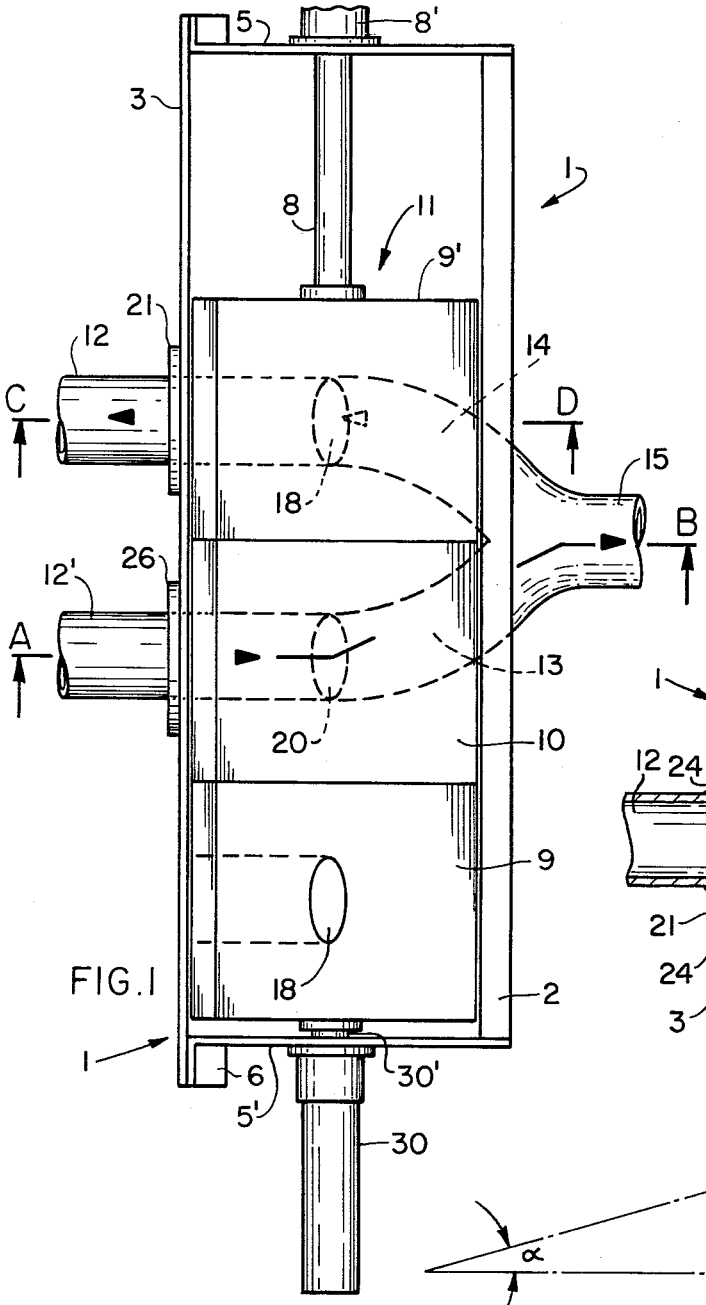
FIG. 1 is a top plan view of the valve according to the invention with the top wall of the valve housing removed.

DETAILED DESCRIPTION OF PREFERRED EXAMPLE EMBODIMENTS:

The top plan view of FIG. 1 shows the general arrangement of the parts relative to each other. A prism valve plug 11 is located in a valve housing 1. The valve plug piston 11 comprises three sections, namely, a central section 10 flanked by two outer sections 9 and 9'. Two pump cylinders 12 and 12' are connected to the valve housing 1 and a conveying conduit 15 is connected to the respective ports in the valve housing through a Y-conduit member having legs 13 and 14. The valve plug piston 11 is movable back and forth by means of a plunger 8 and the direction of flow is indicated by the arrowheads.

Figure 3:
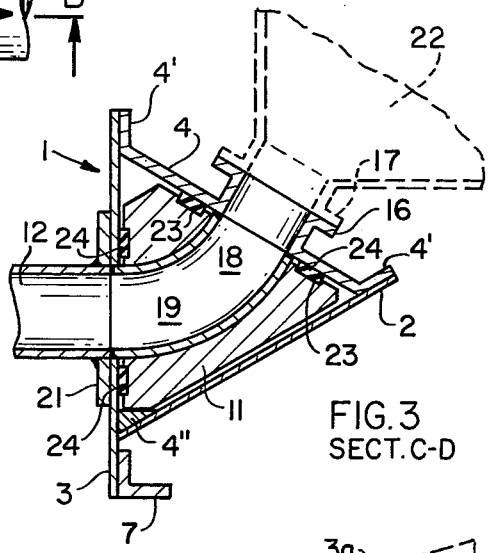
FIG. 3 is a sectional view along section line C–D in FIG. 1.

The valve housing 1 comprises three walls 2, 3, and 4 as best seen in FIG. 3, whereby the connection from wall to wall may be accomplished through outwardly bent flanges 4' and/or by respective moldings 4''. This feature of the invention makes it possible to easily assemble and disassemble the valve housing and to replace any sealing means or entire walls if necessary. The end faces of the housing 1 are closed by covers 5 and 5'. To facilitate the connection between the longitudinal walls of the valve housing and the covers 5, 5' the walls or the covers may be provided with respective flanges 6 through which screws or the like would extend.

The cross sectional shape of the housing is easily determined by the cross sectional configuration of the molding 4'' and by the size of the top covering wall 4, as well as by the flanges 4' of the top covering wall 4. As mentioned, the top housing wall 3 may be connected to the covers 5 and 5', as well as to the housing walls 2 and 3.

Figure 2:
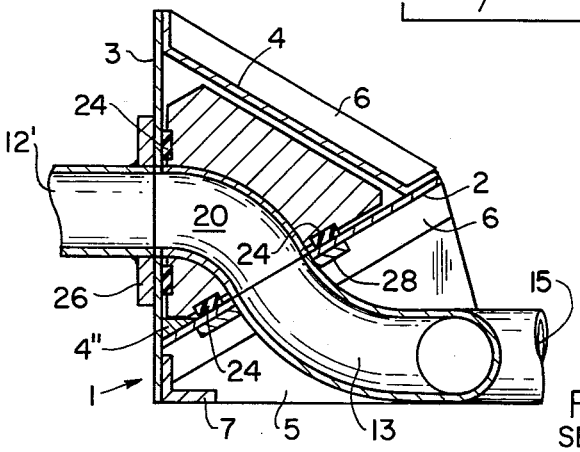
FIG. 2 is a sectional view through the valve according to the invention along the section line A–B in FIG. 1.

The valve housing 1 may be provided with a support means such as an angle iron 7, shown in FIG. 2. Furthermore, the cover members 5 and 5' may extend downwardly as best seen in FIG. 2 to provide a secure support for the entire structure together with the angle iron 7.

The piston 11 with its sections 9, 9' and 10 is movable by a piston rod or plunger 8 extending through the cover 5 and through a respective bearing 8'. The other end of the piston 11 is connected to a bearing rod 30' extending through the cover member 5' and into a stuffing box 30. The inner length of the housing 1 and the length of the piston 11 are selected relative to each other in such a manner that in one end position of the piston 11 one of the sections 9, 9' closes a suction inlet port of the housing to a supply container 22. In the same position, the central section 10 or rather the passageway in the central section 10 interconnects one pump cylinder 12, 12' with the respective leg 13, 14 of the Y-conduit member. Simultaneously the other end section 9, 9' is connected with its respective passageway 16, 17 to the supply container 22. Thus, such other passageway in the end section connects the supply container 22 to the respective pump cylinder 12, 12' while simultaneously closing the respective leg of the Y-conduit member 13 or 14. For the just described purpose, there are provided passageways 18 in the end sections 9, 9'. These passageways 18 are somewhat bent, as best seen in FIG. 3. Preferably, the passageway 18 is lined with a replaceable elbow 19 of a highly wear resistant material, such as alloyed steel or the like. The central section 10 is provided with a passageway 20 as best seen in FIG. 2. Passageway 20 may be slightly bent or straight and is preferably also lined with a steel alloy.

In the preferred arrangement the supply container 22 is arranged above the valve to take advantage of gravitational flow and the conveyor conduit 15 with its Y-conduit connecting member is located slightly below the valve housing proper, as best seen in FIG. 2. FIG. 2 shows the passage from the pump piston 12' to legs 13 of the Y-conduit connector and into the conduit 15. The ports at the ends of the passageways 18 and 20 are sealed relative to the housing walls. For this purpose ring grooves 23 surround the respective ports either in the piston or in the housing wall. Sealing rings, such as O-rings or the like 24 are held in these grooves 23. These rings are thus easily replaceable. Preferably, the inner surfaces of the housing walls are covered with a hard silicon caoutchouc.

The two pump cylinders 12 and 12' are secured to the housing wall 3 by respective flanges 21 and 26. Similarly, flanges 28 connect the legs 13, 14 of the Y-conduit connector to the housing wall 2.

The drive means for moving the piston 11 back and forth and the control means such as trip dogs for controlling such back and forth shifting are not shown, however, these elements are well known in the art.

Incidentally, from FIG. 3 it will be appreciated that the piston of the pump, not shown, sucks the material out of the container 22 through the passageway 18 into the pump piston 12.

Figure 4:
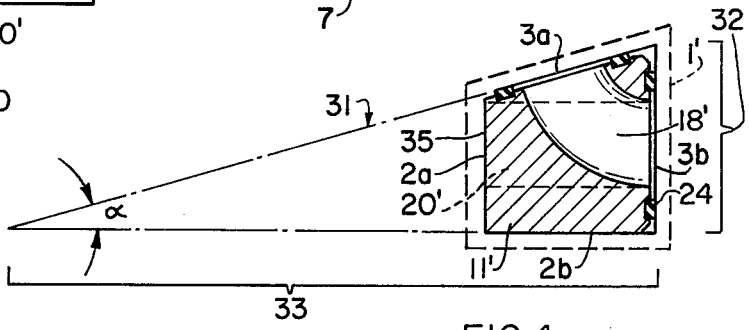
FIG. 4 is a sectional view similar to that of FIG. 3, however, through a modified embodiment of a valve plug according to the invention having a quadrangular cross sectional shape.

Referring to FIG. 4, there is shown a modified embodiment in which the valve plug piston 11' has a quadrangle cross sectional area, whereby the cross section is determined by a rectangular triangle having a hypotenuse 31, a short leg 32 and a long leg 33. The housing 1' in the embodiment of FIG. 4 has also a quadrangle cross sectional area, however, for simplicity's sake the housing is merely shown by dashed lines. The piston is also provided with passageways 18' and 20'. The piston 11' is bounded by an upper wall 3*a*, a vertical longer wall 3*b*, a lower wall 2*b* extending substantially horizontally and a shorter substantially vertical wall 2*a*. Stated differently, the wall 2*a* extends in parallel to the wall 3*b* and is spaced from the latter by the width of the wall 2*b*. The respective housing walls could be provided with flanges along their edges for interconnection.

Where the housing walls are provided with the respective flanges along their longitudinal and short edges, it is not necessary to employ moldings 4'', as shown in FIGS. 2 and 3.

The walls 3*a* and 3*b* enclose an angle of about 75°. The wall 3*b* has a width corresponding substantially to the longitudinal dimension of the short leg 32 of the rectangular triangle. The wall 2*b* has a width corresponding substantially to 0.7 to 1.5 times the longitudinal dimension of the short leg 32. The angle corresponds to about 15°. From the just described configuration, it will be seen that the passageway 18' from the container 22 to one of the pump cylinders bends through an angle of 75°, which opens toward the long leg 33 and which is included between the hypotenuse 31 and the short leg 32. Thus, it will be appreciated that the configuration of the valve plug piston 11' is determined by lines forming the triangle 31, 32 and 33 and by a truncating line 35 extending in parallel to the short leg 32 and forming the wall 2a.

The embodiment of FIG. 4 is especially suitable for handling substantial, large pumping heights and as described, the quadrangle is formed inside a rectangular triangle, whereby the short leg of the rectangular triangle forms one wall of the quadrangle and a parallel to the short leg forms another wall of the triangle. The width or length of the wall interconnecting the two parallel walls should be about 0.7 to 1.5 times the length of the short leg of the rectangular triangle and the hypotenuse should include with the long leg of the triangle at an angle of about 15°.

The embodiment of FIG. 4 has the advantage that the discharge passageway through the valve plug piston can be entirely straight, as shown in dashed lines at 20 in FIG. 4. This feature reduces the power necessary for the switch-over. Moreover, just as in the embodiment with a valve plug piston of triangular cross section, the advantage is achieved that the ports of the passageways are located in a plane surface and an angular elbow in the suction passageways is also avoided.

While it is preferable that the ports of the passageways should be round, it is also satisfactory if the ports are oval, for example, where the passageway extends straight through the valve plug piston. This oval in a plane surface is more advantageous than the oval on a cylindrical surface, because according to the invention, the oval in a plane facilitates the locating and securing of the sealing rings 24 in the grooves 23. However, as mentioned, it is preferable to have circular ring grooves around the ports for the insertion of the sealing rings, whereby one or several such ring grooves may surround the respective port opening.

In the embodiment having a triangular section, it is preferable that one surface should be located in a vertical plane as shown in FIGS. 2 and 3. This arrangement permits the connection of the pump pistons to the vertically extending side and the connection of the conveyor conduit with the Y-conduit member on the opposite side, somewhat below the valve while the supply container is arranged above the valve to take advantage of gravity. However, the invention is not limited to this arrangement. It is quite possible to arrange one wall to extend horizontally so that one corner of the triangle would point downwardly, for example.

The construction as disclosed herein, with plane walls has the advantage that maintenance and repair work is greatly facilitated, because the individual walls of the valve housing may easily be removed. The sealing is also improved.

Although the invention has been described with reference to specific example embodiments, it is to be understood, that it is intended to cover all modifications and equivalents within the scope of the appended claims.

What is claimed is:

1. A valving apparatus for interconnecting a double piston pump having two cylinders with conveying conduit means and with supply means comprising a valve housing having a given length, said housing further having a first pair of aligned ports for connecting said valve housing to said two pump cylinders, a second pair of aligned ports for connecting the valve housing to conveying conduit means, and a third pair of aligned ports for connecting the valve housing to said supply means, said ports being aligned at a pair of planes extending transverse to the longitudinal axis of said housing with each port of each pair of ports being aligned with a separate one of said planes, a piston valve plug mounted solely for axial movement in said valve housing, said piston valve plug having a central plug section with a cylindrical central passageway extending through the valve plug and the valve housing in a direction to interconnect ports of said first and second pair in a common plane, a first outer plug section with a first outer bent cylindrical passageway and a second outer plug section with a second outer bent cylindrical passageway, said first and second outer plug sections and said central plug section having together a length shorter than the length of the valve housing to permit the axial displacement of the piston valve plug in said housing, said first and second outer plug sections extending on each side of said central plug section, each of said first and second bent outer passageways including an angle within the range of about 75° to less than 90° in a direction to interconnect ports of said first and third pairs of ports in a common plane, said passageways being axially spaced, whereby in one axial position, said central passageway interconnects one port of said first pair with one port of said second pair, while one of said outer bent passageways interconnects the other of said first pair with one of said second pair, and whereby in another axial position said central passageway interconnects the other ports of said first and second pairs, while the other of said outer passageways interconnects said one of said first pair of ports with the other of said third pair of ports, and means operatively connected to said valve plug for axially moving said valve plug in said valve housing so as to be compatible with the function of suction, pressure and suction in that order for each work cycle of the valve, wherein said valve housing comprises plane walls defining a plug chamber, said piston valve plug also having plane walls fitting into said plug chamber, and wherein at least two of said plane walls of said plug chamber and at least two respective plane walls of said piston valve plug respectively include an angle of up to 75°.

2. The apparatus according to claim 1, wherein said valve plug chamber and the valve plug have a triangular cross section.

3. The apparatus according to claim 2, wherein the sides of the triangular cross section are of equal length.

4. The apparatus according to claim 1, wherein said plug chamber and plug have a quadrangular cross section and wherein two adjacent sides of the quadrangle include an angle of about 75°.

5. The apparatus according to claim 4, wherein said quadrangular cross section is defined by a rectangular triangle which is truncated by a plane extending in parallel to the plane of the shorter leg of said triangle, and wherein said two planes are spaced by a distance corresponding to 0.7 to 1.5 times the length of said shorter leg of said rectangular triangle.

6. The apparatus according to claim 5, wherein the hypotenuse and the long leg of said rectangular triangle include an angle of about 15°.

7. The apparatus according to claim 1, wherein said plane walls of said valve housing and of said valve plug have circular ports therein such that said passageways through said valve plugs merge at a right angle into said ports.

8. The apparatus according to claim 1, wherein said plane walls of said valve housing and of said valve plug have oval ports therein such that said passageways through said valve plug merge at an angle into said ports.

9. The apparatus according to claim 1, wherein said plane walls of said valve plug have ports therein interconnected by said passageways, groove means in said plane plug walls around said ports, and sealing ring means in said groove means.

10. The apparatus according to claim 1, wherein said valve chamber and said valve plug each have a triangular cross section, wherein one of the plane walls of the valve chamber and valve plug extends vertically, whereby said passaways extend upwardly or downwardly toward the respective other plane walls of the valve plug and valve chamber.

11. The apparatus according to claim 1, therein said valve chamber and said valve plug each have a triangular cross section, wherein one of the plane walls of the valve chamber and of the valve plug extends vertically, said double piston pump being operatively connected to said passageways at said vertically extending wall, said supply means being arranged above said triangular cross section and said conveying conduit means being arranged below said triangular cross section whereby one of said passageways extends upwardly and another of said passageways extends somewhat downwardly toward said conveying conduit means.

12. The apparatus according to claim 1, wherein said plane walls of said valve housing comprise means for individually mounting or replacing each valve housing wall.

* * * * *